US005295451A

United States Patent [19]

Takenoya

[11] Patent Number: 5,295,451

[45] Date of Patent: Mar. 22, 1994

[54] AUTOMATIC EMBROIDERING MACHINE HAVING THREAD BREAK DETECTION MEANS

[75] Inventor: Hideaki Takenoya, Tokyo, Japan

[73] Assignee: Janome Sewing Machine Co. Ltd., Tokyo, Japan

[21] Appl. No.: 756,828

[22] Filed: Sep. 9, 1991

Related U.S. Application Data

[63] Continuation of Ser. No. 635,474, Dec. 28, 1990, abandoned, which is a continuation of Ser. No. 506,554, Apr. 6, 1990, abandoned, which is a continuation of Ser. No. 360,786, Jun. 2, 1989, abandoned.

[51] Int. Cl.[5] ..... D05B 21/00; D05B 69/36

[52] U.S. Cl. ..... 112/121.12; 112/103; 112/273

[58] Field of Search ..... 112/273, 278, 103, 121.12, 112/102, 78, 98

[56] References Cited

U.S. PATENT DOCUMENTS 4,221,176 9/1980 Besore et al. ..... 112/121.12
4,825,789 5/1989 Garron et al. ..... 112/273 X

FOREIGN PATENT DOCUMENTS 0633955 11/1978 U.S.S.R. ..... 112/273

*Primary Examiner*—Peter Nerbun
*Attorney, Agent, or Firm*—Michael J. Striker

[57] ABSTRACT

A detection of a broken embroidering thread is repeated several times, and an erroneous detection is prevented by repeatedly detecting an actual breaking. An embroidering operation is re-started from a position a few stitches apart from the thread breaking position, so that a sightly embroidering continuation may be formed. When a first breaking is detected, reading-out of new embroidering data is stopped, and the repeated detections at several times are made by moving a needle vertically at the same position or a slightly displaced position.

2 Claims, 4 Drawing Sheets

AUTOMATIC EMBROIDERING MACHINE HAVING THREAD BREAK DETECTION MEANS

This is a continuation of application Ser. No. 635,474 filed Dec. 28, 1990, abandoned, abandoned, which is a continuation of appl. Ser. No. 506,554 filed Apr. 6, 1990, which is in turn a continuation of appl. Ser. No. 360,786 filed Jun. 2, 1989, abandoned.

BACKGROUND OF THE INVENTION

1. Field of the Invention

The present invention relates to an automatic embroidering machine, and more particularly to a device for detecting a breaking of a thread while an embroidering machine carries out a stitching operation in accordance with a predetermined program, and repairing of the thread breaking in response to the detection.

2. Description of the Prior Art

In a known automatic embroidering machine, when the thread is broken, the stitching is instantly stopped on detecting the breaking of the thread, and after repairing it the embroidering is again started from an embroidering data following the data where the thread was broken. Therefore, embroidering continuation was unsightly, or the data of a few stitchings were often missing. Further, due to erroneous detection, the stitching was sometimes stopped notwithstanding the fact that the thread did not break.

To remove such defects, Japanese Patent Publication No. 58,584/86 has proposed that the detection of the thread breaking is performed over several stitchings, and each of them is regarded as a breaking, and the embroidering is again started from a position before a first breaking so as to prevent unsightly embroidering continuation, ravelling or erroneous stopping.

Since the instantaneous stopping on the first detection is made against an inertia of the running mechanism of the sewing machine, the sewing machine is stopped after several stitchings. When the thread is broken, false or empty stitchings are made, and the re-start is begun after the false stitchings.

If the breaking is caused by the thread twisting about a needle, the needle will be destroyed by moving of a fabric frame.

By forming the false stitchings, the fabric is prone to spoil an embroidering finish.

SUMMARY OF THE INVENTION

An object of the invention is to provide an automatic embroidering machine in which the thread breaking is verified by repeating detection several times, pretty stitches being formed. Thus, the defects discussed above are avoided.

To achieve the object of the invention, the automatic embroidering machine which includes a stitch forming means including a needle thread catching means cooperating with the reciprocating vertically needle, and an embroidering frame for expanding a fabric thereover and movable relative to the stitch forming means in accordance with a predetermined program, comprises a thread breaking detection means which, when a thread is broken during embroidering, stops the reading-out of embroidering data when a detection of the thread breaking occurs, stops moving the embroidering frame, repeats n times detection of the thread breaking at the stopping position of the embroidering frame, and determines the thread breaking only when it repeatedly detects the thread breaking; and means which automatically returns the embroidering frame from the stopping position after the determination of the thread breaking.

The invention will be explained in detail with reference to the attached drawings.

DETAILED DESCRIPTION OF THE PREFERRED EMBODIMENTS

In the automatic embroidering machine, a fabric to be embroidered is set over an embroidering frame which is moved in X- and Y-directions in accordance with programs, and the fabric is formed with embroidered patterns by means of a needle and a needle thread catching means cooperating with the needle.

The program controls the movement in X- and Y-directions of the embroidering frame per one stitching, and vertical movements of the needle.

Figure 1:
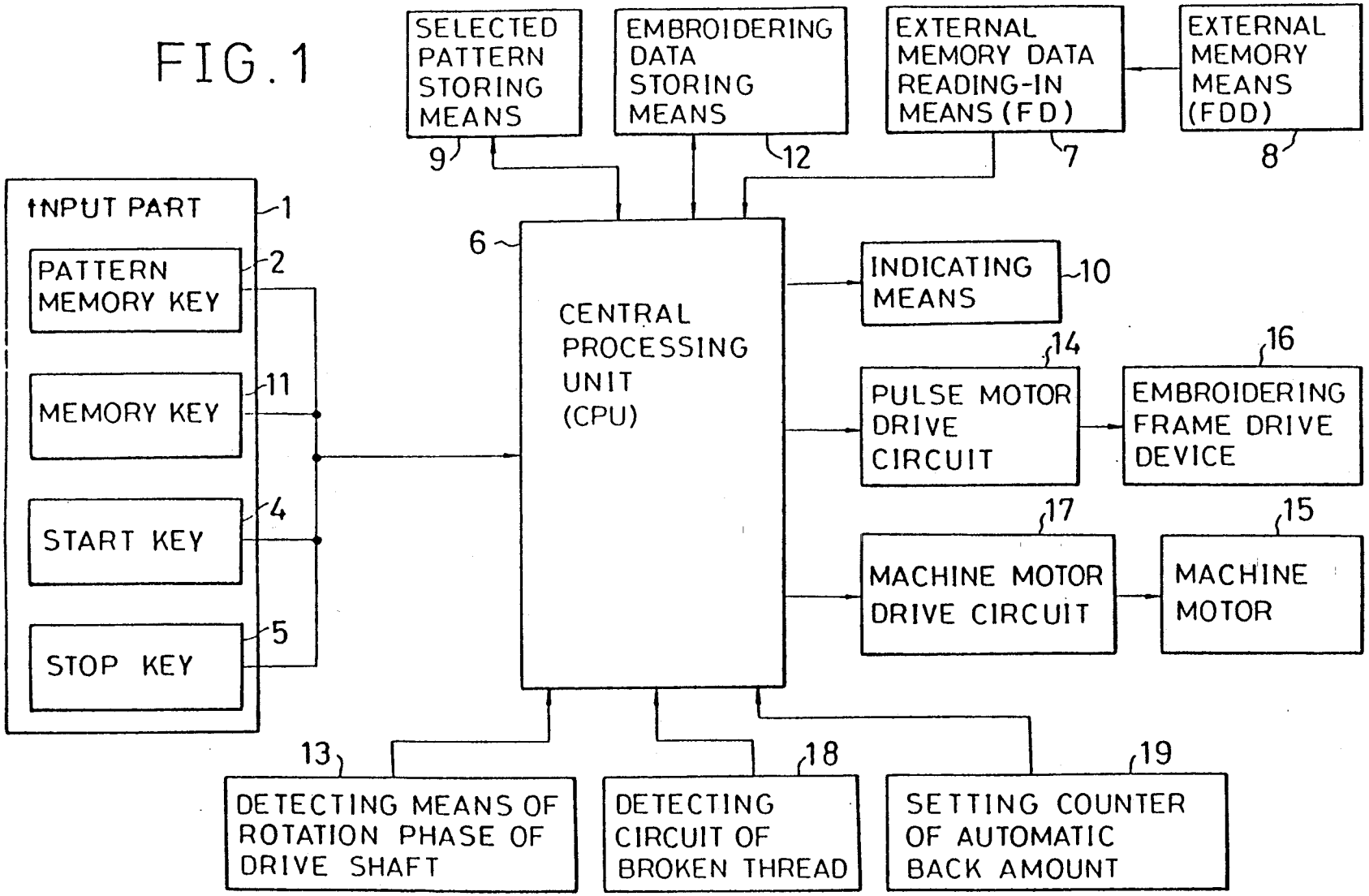
FIG. 1 is a block circuit diagram of an embodiment of the embroidering machine of the invention.

FIG. 1 is a block circuit diagram of the automatic embroidering machine, wherein an input part 1 includes a pattern selecting key 2 for selecting desired patterns, a memory key 11 for storing the selected patterns, a start key 4 for starting the embroidering, and a stop key 5. The keys are connected to a central processing unit 6 (CPU).

An external memory data reading-in means (FD) 7 reads out embroidering data from an external memory means (FDD) 8 such as a floppy disc, which stores embroidering data made up in accordance with the patterns to be embroidered.

A selected pattern storing means 9 stores, by operating a memory key 11, the pattern selected by the pattern selecting key 2 which selection is shown in an indicating means 10.

An embroidering memory means 12 reads out, via the external memory data reading-in means (FD) 7, the embroidering data of the patterns selected by the pattern memory key 2 from the external memory means (FDD) 8.

A detecting means of rotation phases of a drive shaft 13 detects the position of the needle by means of a disc mounted on the drive shaft (not shown), and a known detecting means of the rotation phases includes a photointerrupter (not shown).

A pulse motor drive circuit 14 is connected to CPU 6 and drives an embroidering frame drive device 16 according to the embroidering data from the embroidering data memory means 12 while the needle is above the fabric by the detecting signal of the detecting means 13.

A machine motor drive circuit 17 for a machine motor 15 is connected to the CPU.

A broken thread detecting circuit 18 is connected to the CPU.

A setting counter 19 of automatic back amount after breaking the thread can set stitching numbers of more than one stitching.

Figure 2:
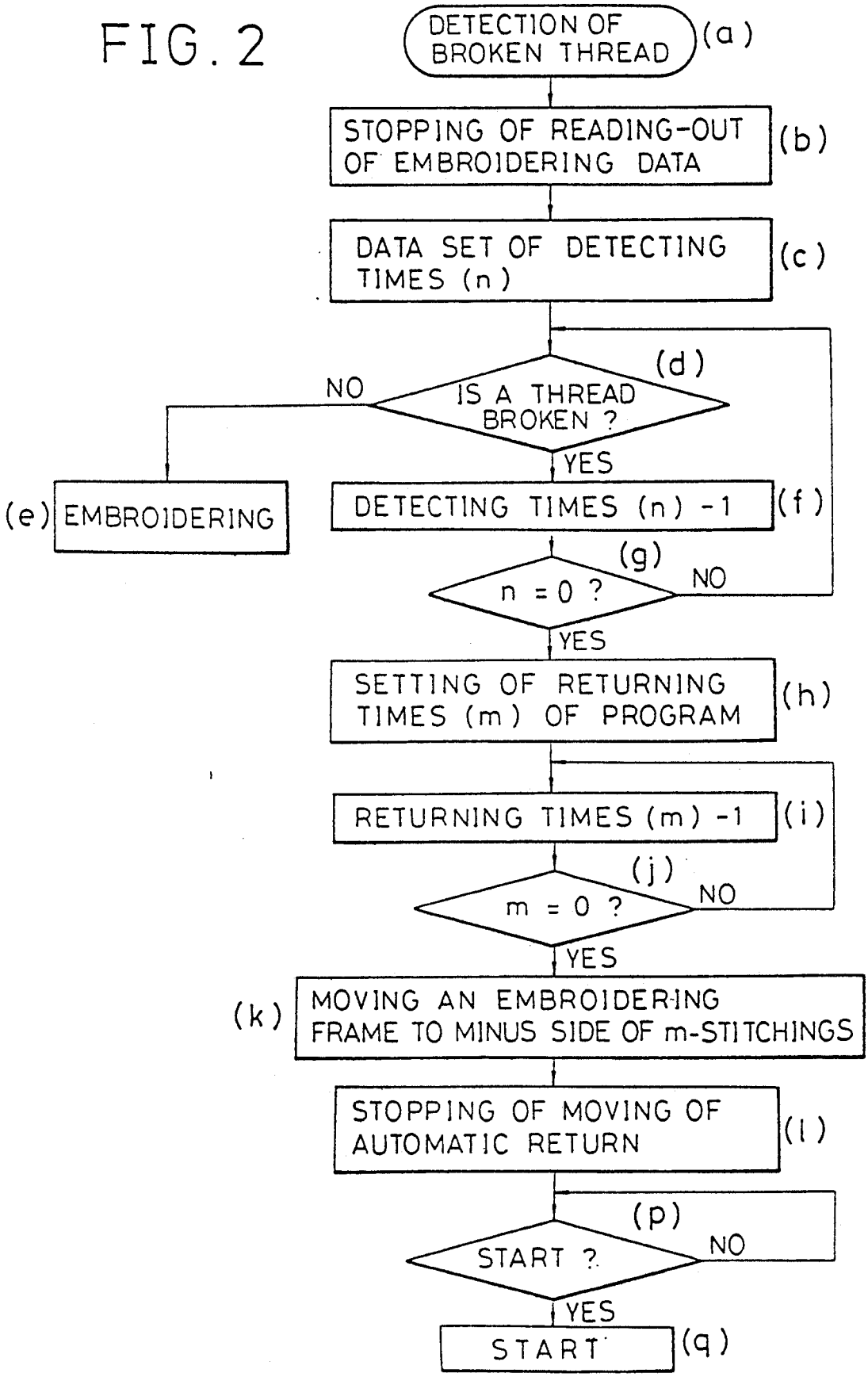
FIG. 2 is a flow chart of the above embodiment.

The operation of the invention will be explained with reference to the flow chart of FIG. 2 showing program steps from the detection of breaking of the thread to the re-start.

At step (a), the detecting circuit 18 detects the breaking of the thread, and this detection is made when the thread tension is strongest during one reciprocation of the needle.

However, depending upon the thread tension, the detector sometimes detects by error the breaking in spite of non-breaking. Since such an erroneous detection hardly happens successively, the detection is checked n times during the subsequent steps shown in the flow chart. Therefore, at subsequent step (b), the reading-out of the embroidering data from the data memory means 12 is stopped instantly.

At step (c), a number n of repetitions of the detecting is set.

At steps (d) to (g), whether the thread is actually broken or not is verified by reciprocating the needle vertically at the detecting position of the step (a).

When it is found by verification that the thread is not broken, it is judged that the first detection was erroneous, and at step (e), the reading-out of the embroidering data from the data memory means 12 which has been stopped at the step (b), is re-started.

When the thread breaking is detected at the step (d), 1 is subtracted from the number n which has been set at step (c).

At step (g), it is interrogated whether the number n set at step (f) is 0 or not. If it is not 0, the detecting circuit 18 continues to verify whether the thread is broken or not, by jumping into an input side of the step (d) where the needle is reciprocated vertically at the detecting position of the step (a).

When the thread breaking is detected successively, the steps (f) and (g) are repeated until number n is 0.

When n is 0, it is assumed that the thread breaking had occurred, and a return processing number m of the program is set at next step (h). The magnitude of the return processing number m may be predetermined at will as a number other than 1, as the detecting position stops at a determined position, irrespective of the detection number n.

The embroidering data is retrieved, as the needle is held at an upper dead point, by m stitches from the position of stopping the reading-out of the embroidering data memory 12 at steps (i), (j), (k) and is read out to drive the embroidering frame drive device 16.

At step (1), the embroidering drive frame 16 is stopped at a position before the m-th stitch.

At step (p), the embroidering is delayed until the start key 4 is operated.

At step (q), the embroidering is started from the moving position by operating the start key 4.

Figure 3:
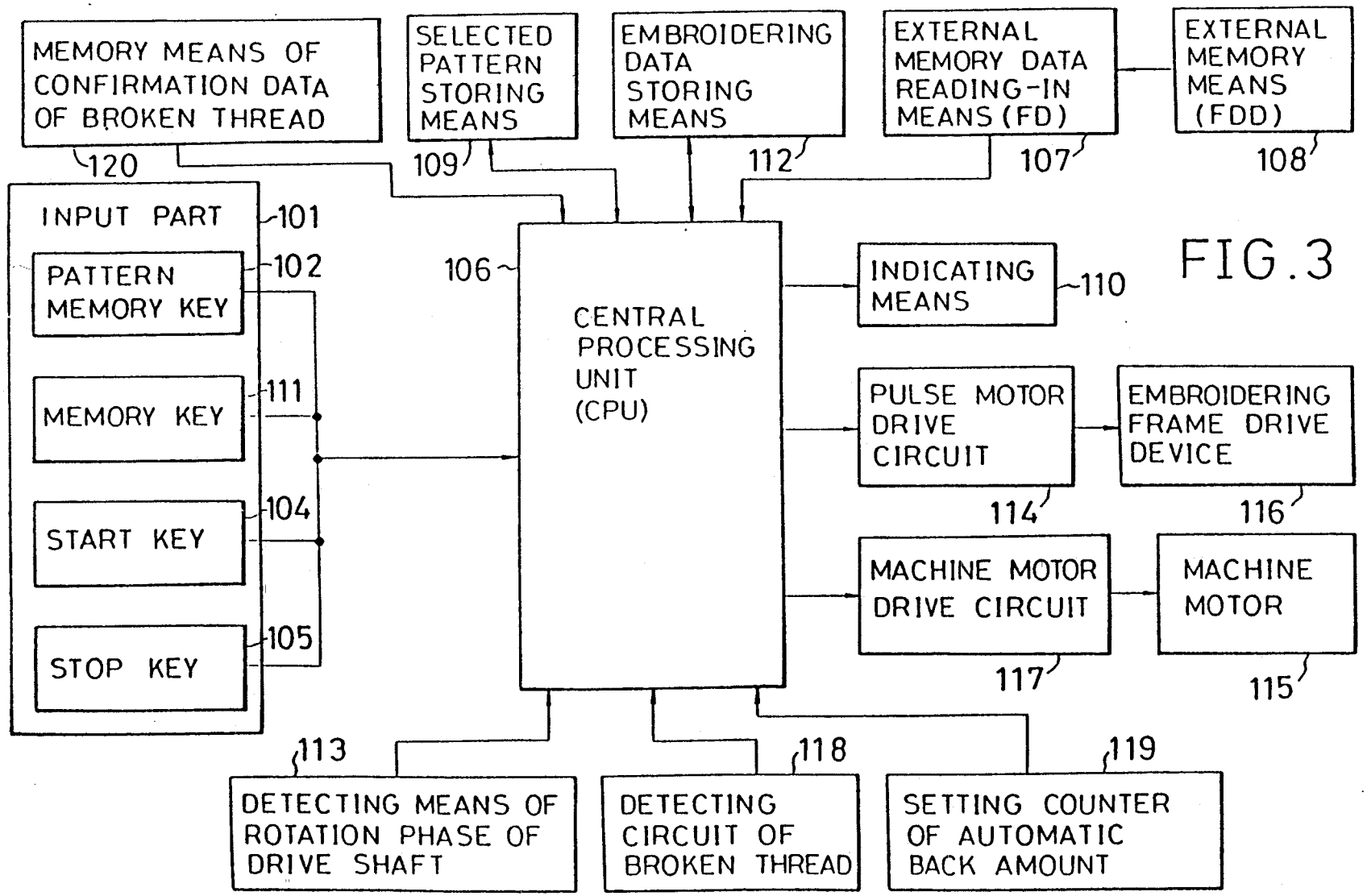
FIG. 3 is a block circuit diagram of another embodiment of the embroidering machine of the invention.
Figure 4:
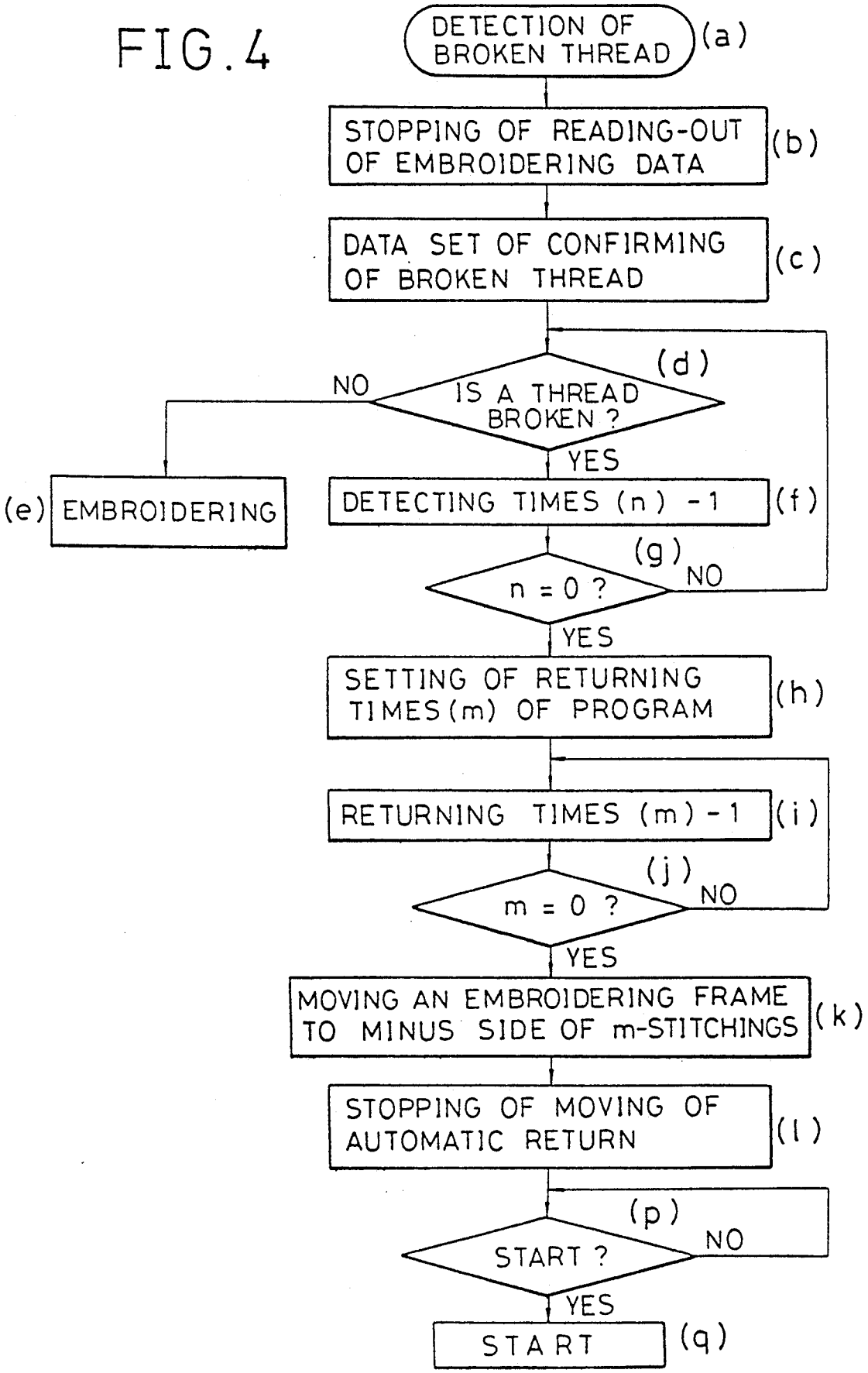
FIG. 4 is a flow chart of the another embodiment.

The present embodiment is characterized in that the reading-out of the embroidering data is stopped upon the detection of the thread breaking at the step (a), and at this position, the needle is moved vertically n times for determining the thread breaking. Such an embroidering may be performed in a modified embodiment shown in the control block diagram of FIG. 3 and the flow chart of FIG. 4 wherein the reading-out is stopped at the same position as in the first embodiment, and the embroidering frame is slightly driven when the needle is moved vertically in accordance with an independently predetermined repetition number n for confirming the thread breaking, so that the stitching thread is not influenced by penetration of the needle into the same perforation.

Such data for confirming the thread breaking does not influence the embroidering patterns, and the frame is moved.

I claim:

1. An automatic embroidering machine which is composed of a stitch forming means including a needle thread catching means cooperating with a vertically reciprocating needle, and an embroidering frame for expanding a fabric thereover and moving relatively with respect to the stitch forming means in accordance with a predetermined program, comprising:

a thread breaking detection means which, upon a detection of a broken thread during embroidering, stops reading-out of embroidering data from a memory, stops moving of the embroidering frame at a position where the thread is broken, repeats the detection n times, wherein n is greater than zero at the stopping position of the embroidering frame, and determines actual thread breaking only when it repeatedly detects the thread breaking; and a means which, upon the actual determination of the thread breaking, automatically returns the embroidering frame at least one stitch apart from the stopping position.

2. An automatic embroidering machine which is composed of a stitch forming means including a needle thread catching means cooperating with a vertically reciprocating needle, and an embroidering frame for expanding a fabric thereover and moving relatively with respect to the stitch forming means in accordance with a predetermined program, comprising:

a thread breaking detection means which, upon a detection of a broken thread during embroidering, stops reading-out of embroidering data from a memory, stops moving of the embroidering frame at a stopping position, repeats the detection n times, wherein n is greater than zero, while slightly moving the embroidering frame into a position which is different from its stopping position, and determines actual thread breaking only upon a repeated detection of the thread breaking; and a means which automatically returns the embroidering frame at least one stitch apart from the stopping position after the actual thread breaking has been determined.

* * * * *